US005410765A

United States Patent [19]

Dicken

[11] Patent Number: 5,410,765

[45] Date of Patent: May 2, 1995

[54] CRIB BUMPER PAD

[76] Inventor: Kevin Dicken, 6257 Clause Rd., Riverbank, Calif. 95367

[21] Appl. No.: 157,867

[22] Filed: Nov. 24, 1993

[51] Int. Cl.[6] ..... A47D 7/00

[52] U.S. Cl. ..... 5/93.1; 5/424

[58] Field of Search ..... 5/93.1, 424, 663

[56] References Cited

U.S. PATENT DOCUMENTS

| | | | |
|---|---|---|---|
| 949,389 | 2/1910 | Almgren | 5/93.1 |
| 3,018,492 | 1/1962 | Rosen | 5/93.1 |
| 3,619,824 | 11/1971 | Doyle | 5/93.1 X |
| 3,877,090 | 4/1975 | Schutz | 5/93.1 |
| 4,672,698 | 6/1987 | Sands | 5/424 |
| 5,010,611 | 4/1991 | Mallett | 5/93.1 X |

*Primary Examiner*—Michael F. Trettel

*Attorney, Agent, or Firm*—Townsend and Townsend Khourie and Crew

[57] ABSTRACT

A bumper pad (3) for a crib (4) having vertical support posts (10) and a mattress (20) includes flexible padding (26) extending around the interior boundary of the crib to form a cushioned bumper along the periphery of the mattress and a plastic canvas stiffener (32) extending from the underside of the flexible padding. The stiffener fits tightly into the space between the mattress and the crib to provide support for the padding and to prevent the child from inserting his/her limbs between the bumper and the mattress. A cover (34) encases the padding and the stiffener and tie strings (42) secure the cover to the vertical support posts of the crib. Alternatively, the stiffener need not be fixed to the padding; in this case, the cover has an opening (50) to allow removal of the stiffener for washing or other purposes.

14 Claims, 2 Drawing Sheets

CRIB BUMPER PAD

BACKGROUND OF THE INVENTION

The present invention relates generally to baby cribs and more specifically to a crib bumper pad.

Permanently mounted or removable rail or bar restraints are widely used to prevent children or the incapacitated from falling out of bed. Unfortunately, these restraints typically allow the head, arms and/or legs to be inserted through the rails or bars of the bed or crib. These limbs may then become lodged between the rails or accidently struck by moving people or objects outside the crib.

To reduce these dangers, crib bumper pads have been developed. Typically, these crib bumper pads are thin, padded strips covered with fabric or plastic and positioned on top of the mattress around the interior boundary of the crib. Other bumper pads have inflatable padded strips that are connected together and inflated to form a cushioned bumper around the crib. Although the padded strips are usually fastened to the crib, they still may permit the insertion of the child's head, arms or legs between the mattress and the bumper strip itself. Thus, they do not completely eliminate the danger of limbs being caught between the bars of the crib or bed.

Another problem with existing bumper pads is that they tend to be loosely stuffed with filler material. This results in the filler material being redistributed as the crib bumper is handled, particularly when it is washed, such that the crib bumper starts to lose its shape. This loss of shape may cause some portions of the bumper to become thinner and, therefore, provide less protection to the child.

SUMMARY OF THE INVENTION

The present invention is directed to a crib bumper pad adapted for a crib having vertical support posts and a mattress. The bumper pad includes flexible padding extending around the interior boundary of the crib to form a cushioned bumper along the periphery of the mattress and a stiffener extending from the underside of the flexible padding. The stiffener fits tightly into the space between the mattress and the crib both to support the flexible padding and to prevent the child from inserting its limbs between the mattress and the padding.

The stiffener and flexible padding are encased within a cover. A plurality of tie strings are attached to the outer surface of the cover for attaching them to the vertical support posts of the crib to secure the bumper pad to the crib. The tie strings can be detached from the crib so that the entire bumper pad can be removed for washing, to change the bed linens, or for other purposes.

In an alternative embodiment, the stiffener is a separate piece from the flexible padding and is made of a nonwashable rigid material. The cover includes an opening sized for insertion and removal of the stiffener so that the cover and flexible padding can be washed. The opening can be fastened by a hook and loop fastener (such as VELCRO TM), a zipper or similar means.

In another embodiment, resilient padding (such as plastic foam) is encased within the cover in place of both the flexible padding and the stiffener. The resilient padding has an upper portion sized to form a cushioned bumper along the periphery of the mattress and a lower portion sized to tightly fit within the space between the mattress and the crib. The lower portion prevents the child from moving the bumper pad and reaching the support posts of the crib.

One of the primary advantages of the invention is that the stiffeners provide support (i.e. stiffen) the flexible padding so that the flexible padding will not easily move. This makes it difficult for children to insert their heads, arms or legs between the mattress and the bumper pad.

Another advantage of the invention is that the stiffener holds the flexible padding in place. Therefore, the padding will not be redistributed when the crib bumper is handled and the crib bumper will substantially maintain its shape.

Other features and advantages of the invention will appear from the following description in which the preferred embodiment has been set forth in detail in conjunction with the accompanying drawings.

DETAILED DESCRIPTION OF A PREFERRED EMBODIMENT

Figure 1:
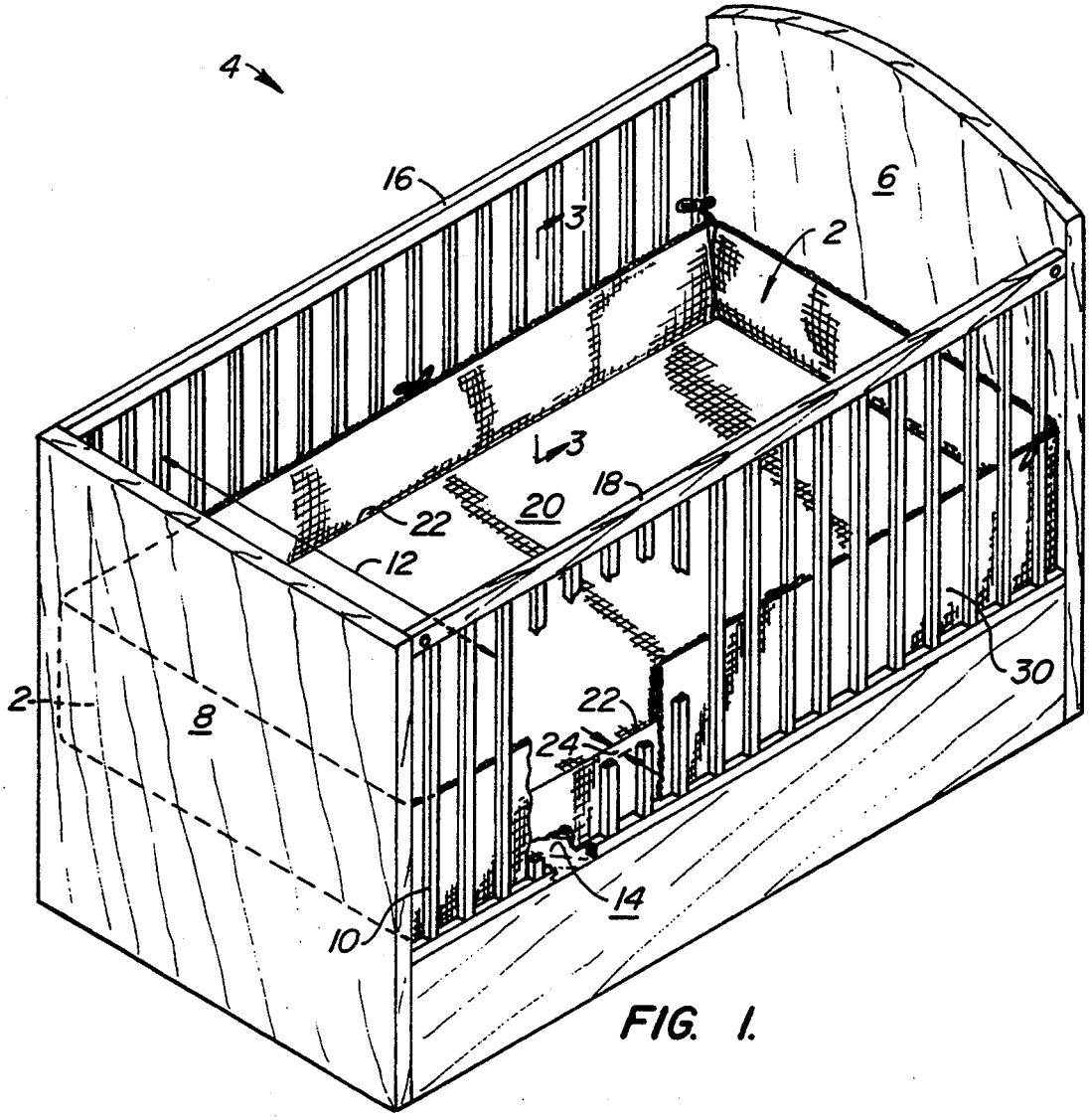
FIG. 1 is a perspective view of a standard crib having a crib bumper pad of the present invention with a cutaway to illustrate specific features of the bumper pad.

FIG. 1 illustrates the preferred embodiment of a crib bumper pad 2 in a standard crib 4 with a headboard 6, a footboard 8 and a plurality of vertical support posts 10 defining an interior boundary 12 inside crib 4. Support posts 10 extend from bottom surface 14 of crib 4 to two horizontal bars 16, 18. Horizontal bars 16, 18 are typically attached to footboard 8 and headboard 6 of crib 4 at a sufficient height above bottom surface 14 so that the child cannot easily climb out of the crib 4. Crib 4 further includes a mattress 20 disposed on bottom surface 14 of crib 4, the mattress having a periphery 22 extending around interior boundary 12. Mattress 20 typically fits within the interior boundary 12 of crib 4 so that periphery 22 of mattress 20 and interior boundary 12 define a space 24 between them.

Bumper pad 2 is positioned around interior boundary 12 against the sides and headboard 6 of crib 4. Bumper pad 2 is sized to rest on the upper edge of periphery 22 of mattress 20 and to extend into space 24 between mattress 20 and interior boundary 12 (best seen in FIG. 3). Bumper pad 2 extends upwards from bottom surface 14 of crib 4 to prevent the child from reaching support posts 10. The invention, however, is not limited to this arrangement. For example, bumper pad 2 can be sized to extend around the entire interior boundary 12 of crib 4 to protect the child from coming into contact with headboard 6 or footboard 8. On the other hand, the invention may comprise two bumper pads each extending along one side of crib 4 to only prevent the child from reaching support posts 10. Further, the bumper pads can extend higher above mattress 20 and further up support posts 10 depending on the age and/or dexterity of the individual child.

Figure 3:
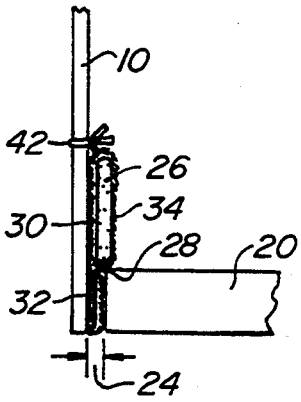
FIG. 3 is a cross sectional view of the bumper pad of FIG. 1 along line 3.
Figure 2:
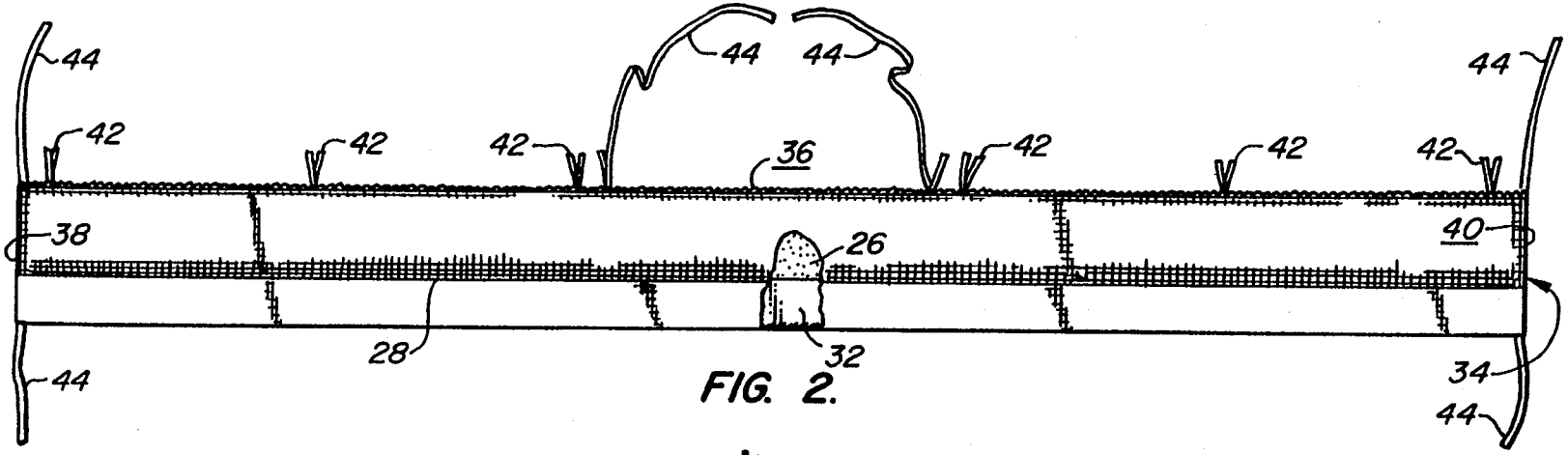
FIG. 2 is a side view of the bumper pad of FIG. 1 outside of the crib with a cutaway to illustrate a stiffener and flexible paddling inside a cover.

As shown in FIGS. 2 and 3, the upper portion of bumper pad 2 is a flexible padding 26 made of a polyester filler material. Alternatively, flexible padding 26 may be made of foam padding, soft rubber, or some other cushioning material. Flexible padding 26 has an underside 28 resting on mattress 20 and an outer border 30 extending around interior boundary 12 to form a cushioned bumper for crib 4.

The lower portion of bumper pad 2 consists of a plastic canvas stiffener 32 affixed to underside 28 of flexible padding 26 by sewing or other means. Stiffener 32 is sized to fit tightly into space 24 between mattress 20 and interior boundary 12 of crib 4. Stiffener 32 provides support for flexible padding 26 so that the child cannot move the flexible padding 26 and reach support posts 10. Stiffener 32, however, is not limited to a one-piece plastic canvas material.

Figure 4:
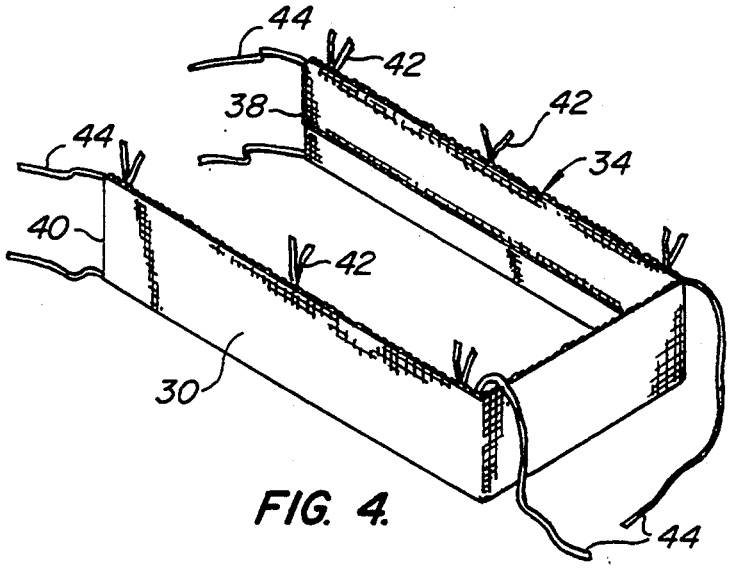
FIG. 4 is a perspective view of the bumper pad of FIG. 1 outside of the crib.

Stiffener 32 and flexible padding 26 are encased inside a cover 34. Cover 34 can be any type of soft cloth material that is comfortable, preferably one that can be washed. Cover 34 has a top surface 36 and two side surfaces 38, 40. A plurality of short tie strings 42 are attached to top surface 36 and a plurality of long tie strings 44 are attached to the central portion of top surface 36 and side surfaces 38, 40 (see FIGS. 2 and 4). Short tie strings 42 secure bumper pad 2 to support posts 10 and long tie strings 44 secure bumper pad 2 to the corner posts (not shown) of crib 4 or to headboard 6 if crib 4 does not contain corner posts. Long tie strings 44 attached to side surfaces 38, 40 tie around footboard 8. Long tie strings 44 serve to anchor bumper pad 2 so that short tie strings 42 will not slide up and down support posts 10. Each tie string can be affixed to cover 34 by sewing, pinning, tying or some other bonding process.

The invention is not limited to the above arrangement. For example, cover 34 can also have tie strings attached to bottom surface 14 of crib 4 to help prevent bumper pad 2 from moving upwards. In addition, connecting mechanisms such as snaps, buckles or similar fasteners other than the tie strings can be used to secure a bumper pad 2 to crib 4.

Figure 6:
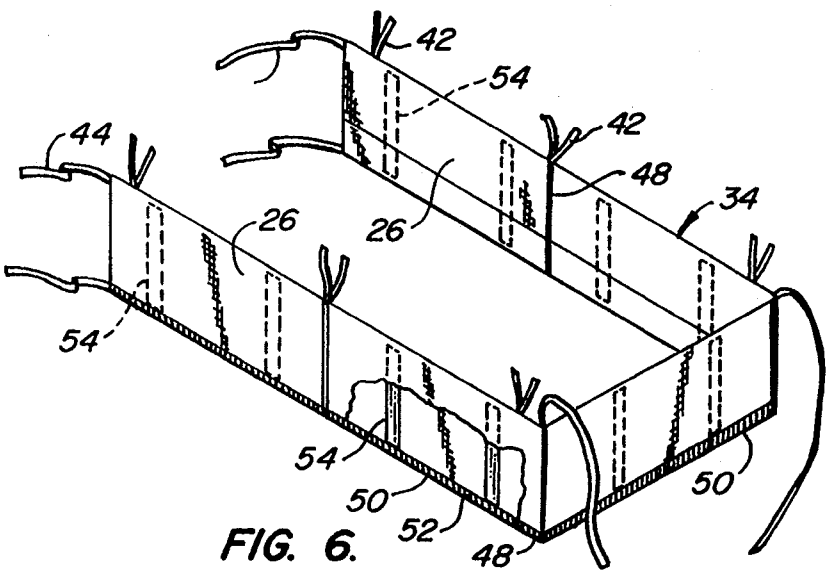
FIG. 6 is a perspective view of the bumper pad of FIG. 5 with a cutaway showing a plurality of slats as the elongated stiffeners.
Figure 5:
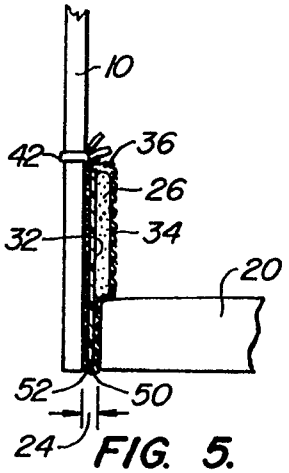
FIG. 5 is a cross sectional view of an alternative embodiment of the bumper pad of FIG. 1 with an elongated stiffener.

FIG. 5 shows an alternative embodiment of the invention in which stiffener 32 is not sewn into flexible padding 26. In this embodiment, stiffener 32 extends from bottom surface 14 of crib 4 to top surface 36 of cover 34 between flexible padding 26 and support posts 10. Stiffener 32 is not affixed to flexible padding 26 and, therefore, stiffener 32 does not help maintain the shape of flexible padding 26. Thus, flexible padding 26 is divided or sectioned into five sections, two disposed on either side of crib and one longer section against footboard 6, as is shown in FIG. 6. Cover 34 has seams 48 between each section of flexible padding 26 to help maintain the shape of bumper pad 2. Cover 34 also has an opening 50 extending along its entire bottom surface. Opening 50 is sized so that stiffener 32 can be removed from cover 34 and can be fastened by any type of fastening means such as a zipper 52 or a hook and loop fastener (such as VELCRO TM).

In this embodiment, stiffener 32 need not consist of a washable material because stiffener 32 can be removed when bumper pad 2 must be washed. Thus, stiffener 32 may consist of a number of elongated slats 54 (see cutaway in FIG. 6) spaced evenly around periphery 22 of mattress 20 to provide support for flexible padding 26.

Figure 7:
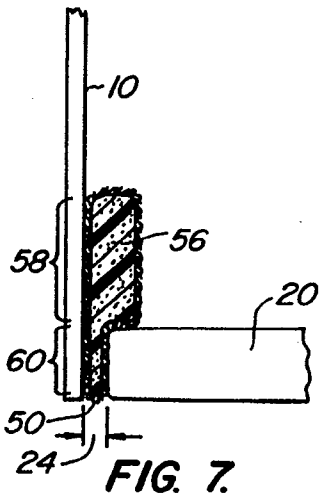
FIG. 7 is another alternative embodiment of the bumper pad of FIG. 1 with resilient padding in place of the stiffener and the flexible padding.

FIG. 7 illustrates another embodiment in which resilient padding 56 takes the place of both flexible padding 26 and stiffener 32. Resilient padding 56 consists of a plastic foam material having an upper portion 58 and a lower portion 60. Upper portion 58 is sized to form a cushioned bumper along periphery 22 of mattress 20 in a similar manner as flexible padding 26. Lower portion 60 is sized to tightly fit within space 24 between mattress 20 and crib 4 in a similar manner as stiffener 32. Lower portion 60 provides support for upper portion 58 because it is lodged into space 24. Thus, the child will be unable to move resilient padding 56 to reach support posts 10.

Other modifications and variations can be made to the disclosed embodiments without departing from the subject invention as defined in the following claims. For example, the invention is not limited to the crib described above and the bumper pad of the present invention can be used with any type of enclosure. Stiffener 32 provides some support to flexible padding 26 even if it is not lodged into space 24 between mattress 20 and support posts 10. Therefore, the bumper pad can be used in conjunction with a crib that does not have a mattress or one that is tightly fitted with a mattress so that there is no space between the mattress and the crib. Additionally, the bumper pad may be used with hospital beds that incorporate metal restraining side rails to protect the infirm or with animal cages to prevent animals from reaching through the rails of the cage.

What is claimed is:

1. In a crib having a plurality of vertical support posts, a headboard and a footboard forming an interior boundary and a mattress disposed within the crib, the mattress defining a space between the periphery of the mattress and the interior boundary of the crib, a bumper pad comprising:

flexible padding extending around the interior boundary of the crib to form a cushioned bumper along the mattress periphery adjacent the support posts, headboard and footboard;

at least one stiffener affixed to the padding and extending into the space between the mattress periphery and the interior boundary of the crib, the flexible padding having an underside and the stiffener being permanently secured to said underside; and means for securing the padding to the support posts.

2. The bumper pad of claim 1 further comprising a cover encasing the flexible padding and the stiffener.

3. The bumper pad of claim 2 wherein the cover includes an opening sized to allow removal of the stiffener and the flexible padding, the opening being closable by a fastener.

4. The bumper pad of claim 3 wherein the fastener is a hook and loop fastener.

5. The bumper pad of claim 3 wherein the fastener is a zipper.

6. The bumper pad of claim 2 wherein the securing means includes a plurality of tie strings attached to an outer surface of the cover, the tie strings securing the cover to the vertical support posts of the crib.

7. The bumper pad of claim 6 wherein the securing means further includes tie strings securing the cover to the headboard and to the footboard of the crib, the tie strings resisting vertical movement of the bumper pad.

8. The bumper pad of claim 1 wherein the stiffener is sized to tightly fit within the space between the mattress and the crib.

9. The bumper pad of claim 1 wherein the stiffener consists of a plastic canvas material extending around the interior boundary of the crib such that the space is substantially filled by the canvas material.

10. The bumper pad of claim 1 wherein the flexible padding is a polyester filler material.

11. The bumper pad of claim 1 wherein the flexible padding consists of a plurality of foam pads.

12. In a crib having a plurality of vertical support posts, a headboard and a footboard forming an interior boundary and a mattress disposed within the crib, the mattress defining a space between the periphery of the mattress and the interior boundary of the crib, a bumper pad comprising:

flexible padding extending around the interior boundary of the crib to form a cushioned bumper along the mattress periphery adjacent the support posts, headboard and footboard;

at least one stiffener affixed to the padding and extending into the space between the mattress periphery and the interior boundary of the crib, the stiffener being removably secured to the flexible padding; and means for securing the padding to the support posts.

13. A bumper pad adapted for a crib having a plurality of vertical support posts, a headboard and a footboard forming an interior boundary and a mattress disposed within the crib, the mattress defining a space between the interior boundary of the crib and the periphery of the mattress, the pad comprising:

resilient padding extending around the interior boundary of the crib, the padding having an upper portion and a lower portion, the upper portion being sized to form a cushioned bumper along the mattress periphery adjacent the support posts, headboard and footboard, the lower portion being sized to tightly fit within the space between the mattress periphery and the crib to support the upper portion;

a cover encasing the resilient padding the cover having an opening sized to allow removal of the padding and fastening means being affixed to the cover for closing the opening; and means on the cover for securing the cover to the crib.

14. The bumper pad of claim 13 wherein the securing means includes a plurality of tying means attached to an outer surface of the cover, the tying means securing the cover to the vertical support posts, the headboard and the footboard of the crib.

* * * * *

UNITED STATES PATENT AND TRADEMARK OFFICE

CERTIFICATE OF CORRECTION

PATENT NO. : 5,410,765

DATED : May 2, 1995

INVENTOR(S) : Kevin Youngblood

It is certified that error appears in the above-indentified patent and that said Letters Patent is hereby corrected as shown below:

On the title page, under item [19] and item [76], change "Dicken" to -- Youngblood --.

Signed and Sealed this

Fifteenth Day of August, 1995

*Attest:*

*Attesting Officer*

BRUCE LEHMAN

*Commissioner of Patents and Trademarks*